US007591048B2

(12) United States Patent
Mehner

(10) Patent No.: US 7,591,048 B2
(45) Date of Patent: Sep. 22, 2009

(54) MOISTURE CONDITIONER FOR LINT COTTON

(75) Inventor: Martin Lee Mehner, Lubbock, TX (US)

(73) Assignee: Cotton Picking Mind LP, Lubbock, TX (US)

( * ) Notice: Subject to any disclaimer, the term of this patent is extended or adjusted under 35 U.S.C. 154(b) by 0 days.

(21) Appl. No.: 11/875,489

(22) Filed: Oct. 19, 2007

(65) Prior Publication Data

US 2009/0100643 A1 Apr. 23, 2009

(51) Int. Cl.
*D01B 1/00* (2006.01)

(52) U.S. Cl. ..... 19/66 CC; 19/48 R

(58) Field of Classification Search ..... 19/39, 19/40, 48 R, 66 CC
See application file for complete search history.

(56) References Cited

U.S. PATENT DOCUMENTS 4,140,503 A * 2/1979 Vandergriff ..... 55/290
5,381,587 A * 1/1995 Vandergriff ..... 19/48 R
6,314,618 B1 11/2001 Mehner et al.
6,698,066 B2 * 3/2004 Latham ..... 19/66 CC

* cited by examiner

*Primary Examiner*—Shaun R Hurley
(74) *Attorney, Agent, or Firm*—Bracewell & Giuliani LLP

(57) ABSTRACT

An apparatus for processing a fibrous material batt like lint cotton to increase the moisture content of the material and to compress the batt of humidified fibers to increase the batt density. A stream of warm humid air is passed through the moving batt of fiber that is constrained between a rotatable hollow cylinder and a stationary perforated screen. The air passing through the batt of figure removes debris from the batt and carries the debris to an associated plenum. The batt is doffed off the rotatable cylinder by a roller that serves to both doff and compress the batt. A roller doffs the fiber batt from the rotatable cylinder and doffs and compresses the batt against a compression roller.

17 Claims, 4 Drawing Sheets

MOISTURE CONDITIONER FOR LINT COTTON

BACKGROUND

1. Field of Invention

This disclosure herein relates in general to processing fibrous materials and in particular to a system for humidifying lint cotton and other fibrous materials with an enhanced manner of removing debris and other fibrous materials and compressing the fiber batt to increase its density.

2. Description of Prior Art

The desirability of humidifying or adding moisture to lint cotton in the cotton gin just before baling has been recognized for years. Although humidifying lint cotton increases the weight of the cotton, there are also many significant advantages to adding moisture at this stage of cotton processing. Adding moisture to lint cotton improves the capacity of the bale press whereas dry cotton requires higher compression forces and more time to charge and compact it into the press box. Dry cotton is also more difficult to press into a bale than cotton of normal moisture content. Higher press box compaction pressures require more bale press energy consumption, which causes wear and tear on the bale press components. Thus, humidified lint requires lower compaction pressures and reduces strain on the bale press components while creating bales that are within the acceptable weight range. Adding moisture to the fiber and compressing the batt before the press also enhances the press capacity since a denser volume of cotton is available for each charge of cotton delivered to the press box.

Older cotton presses use troublesome devices known as "dogs" to hold the compacted cotton in the press box while additional cotton is being added to form the bale. Modern high capacity, universal density presses do not use dogs. However, without dogs to hold the cotton in the box during bale formation, dry cotton springs out of the box requiring the tramper to work harder as it re-compacts the cotton. In contrast, humidified lint stays in the box after compaction.

Bands consisting of wires or straps of steel are used to hold the formed bale together after the bale pressing operation. Dry cotton requires additional force to press it into a bale. The additional force causes excessive tension on the bands, thereby causing some of the bands to break during bale storage. Replacing broken bands is an expensive process for the warehouse. The re-banding process can also lead to contamination of the lint fiber which lowers the value of the cotton. Adding moisture to the cotton before the baling process reduces the occurrence of broken bands.

Several prior art methods have had limited success in humidifying lint cotton. Spraying the cotton batt with a fine mist of water to which a wetting agent had been added was probably the first systematic way used to apply moisture to lint cotton. This method was developed by the U.S. Government's Cotton Ginning Laboratory, at Stoneville, Miss., and was described by Charles A. Bennett in his article "Engineering Progress in Cotton Ginning" which appeared in the Cotton Gin and Oil Mill Press on Mar. 22, 1947. The apparatus employing spraying a cotton batt with a fine mist of water is described in U.S. Pat. No. 3,324,513, issued Jun. 13, 1967, to D. B. Hurdt.

Exposing cotton to a stream of warm, humid air is the most popular method of humidifying cotton at the gin. Typically, the warm, humid air is generated by a device manufactured by Samuel Jackson, Inc., under the trademark HUMIDAIRE and controlled by the applicant herein. This device comprises an air heater in which a gas or oil-fired burner operates with an open flame in the stream of air to be humidified. The stream of air passes through an air washer chamber in which recirculated water spray scrubs the heated air, simultaneously cooling the air and evaporating the water. A supply of warm humid air is generated with an air temperature between 120 to 160 degrees F. dry-bulb temperature and 70 to 100% relative humidity.

The relative humidity of the air generated by the HUMIDAIRE device is regulated by independent control of the dry-bulb (air) and wet-bulb (water) temperatures. The closer these two temperatures are together, the higher the relative humidity. Regulating the burner fuel valve controls the dry-bulb temperature. Regulating the butterfly valve for throttling water flow to the spray nozzles in the air washer chamber controls the wet-bulb temperature.

At present, a common lint cotton humidifier is the "Lint Slide Grid Humidifier," U.S. Pat. No. 4,103,397, issued Aug. 1, 1978, to S. G. Jackson. This device comprises a set of louver-like plates, or grids, forming the bottom surface of the lint slide between the battery condenser and press. Humid air is introduced in a plenum below the grids and passes up through the grids and through the cotton batt flowing downward to the press. Although this device offers a low cost solution, it is only capable of applying a limited amount of humid air to the cotton. The effectiveness of this device is limited since some of the air escapes around the cotton batt instead of penetrating it. In addition, this device is incapable of compressing the batt into a desirable denser mass.

An alternative location for applying humid air to the cotton batt is at the battery condenser of the gin. Humid air may be applied just before cotton reaches the doffing rollers of the screen drum of the battery condenser. For an example of this method, see U.S. Pat. No. 2,834,058, issued May 13, 1958, to W. R. Bryant. This humidification method has disadvantages. Since the humid air must pass through the screen drum of the condenser, moisture will often condense on the screen drum in cold weather, thereby causing the screen drum to "hair over" with cotton fibers that cannot be removed by the doffing rollers. Air blockages result and the device soon chokes, resulting in downtime.

Before the introduction of the humidifier of U.S. Pat. No. 4,103,397, warm humid air was injected into the air and lint flowing to the battery condenser. A limited amount of lint humidification could be achieved this way. However, applying enough humid air to affect the moisture of the lint usually resulted in moisture condensing on the cold battery condenser screen, thus hairing the screen over as described before.

U.S. Pat. No. 4,140,503, issued Feb. 20, 1979, to A. L. Vandergriff, describes a method of applying dry, heated air to the condenser screen drum after the doffer rollers to attempt to dry the condensation off the screen. This patent also describes an arrangement of rollers for receiving the humidified cotton batt from the doffing rollers and compressing the cotton batt. The batt leaves the rollers and begins the descent down the slide to the press. Unfortunately, this device retains the inherent problem of moisture condensation on the screen and rollers since it applies moisture in the battery condenser.

U.S. Pat. No. 6,314,618, issued Nov. 13, 2001, to M. L. Mehner et al, describes a method for applying warm humid air to a moving batt of fibers. Here the fibers are constrained in a defined path between a rotating perforated drum and a stationary perforated screen. The fiber batt is doffed from the rotating drum by a roller that serves to both doff the batt and compress it against a smooth stationary plate increasing the density of the batt. The stationary perforated screen allows foreign material into the air plenum area. The foreign material may impede batt travel through the machine leading to chokes and operating downtime. Removing the foreign material can be time consuming.

SUMMARY OF INVENTION

The present disclosure includes an apparatus for processing fibrous material, wherein the fibrous material comprises debris. In one embodiment the apparatus comprises a rotatable first cylinder having a cylindrical surface defining a hollow space therein, the cylinder having an upper portion and a lower portion. The cylinder includes perforations extending through the surface forming annular protrusions on the outer periphery of the perforations, wherein the protrusions define a rough side; wherein the rough side of the surface of the first cylinder is located on the exterior of the first cylinder to enhance gripping fibrous material being processed. Also included is a feed system formed to deliver incoming fibrous material to the upper portion of the first cylinder, a fan configured to direct air flow to the upper portion of the first cylinder; and, a plenum in communication with the lower portion of the first cylinder configured to receive debris removed from the fibrous material. The air flow may comprise hot humid air. The apparatus may further comprise a rotatable second cylinder having a generally cylindrical surface which has an exterior side which has a plurality of irregularities. The second cylinder being located downstream of and spaced apart from the first cylinder by a minimal distance such that the second cylinder doffs said first cylinder.

The air flow to the upper portion of the first cylinder flows into the hollow space within the cylinder through the material and perforations and exits the first cylinder into the plenum. Debris from the fibrous material is carried to the plenum by the air flow. In one embodiment, the plenum is in communication with a fan suction line. The air flow through the first cylinder preferably creates a pressure differential between the upper and lower portion of the first cylinder. The pressure differential is typically of sufficient magnitude to force fibrous material against the upper portion of the first cylinder.

In one embodiment, the second cylinder comprises a plurality of longitudinal members disposed about and parallel to an axis of rotation, each of the members having a leading edge and a trailing edge, the leading edge of each member overlying and contacting the trailing edge of an adjacent one of the members.

Also, a cotton gin is disclosed herein comprising, a battery condenser, and a batt conditioning apparatus formed to receive a stream of fibrous material batt from the battery condenser. The batt conditioning apparatus of the cotton gin comprises a rotatable first cylinder having a cylindrical surface defining a hollow space therein, the cylinder having an upper portion and a lower portion, perforations extending through the surface forming annular protrusions on the outer periphery of the perforations, wherein the protrusions define a rough side and wherein the rough side of the surface of the first cylinder is located on the exterior of the first cylinder to enhance gripping fibrous material being processed. The cotton gin may also include a feed system formed to deliver the batt fibrous material to the upper portion of the first cylinder, a humidifying unit configured to direct hot humid air flow to the upper portion of the first cylinder; and a plenum in communication with the lower portion of the first cylinder configured to receive debris removed from the fibrous material.

The cotton gin may also include a fan formed to draw air from the plenum. The fan may be configured to discharge into the batt condenser. The combination of the air from the humidifying unit blowing on the cylinder and the fan drawing air from the plenum may form a pressure differential on the first cylinder. The pressure differential forces the batt onto the cylinder and promotes air flow through the cylinder.

A method for processing a fibrous batt in a processor is also included herein. The processor comprises a rotatable hollow cylinder with perforations, a feed system, and a plenum. The method comprises feeding the batt to the upper portion of the cylinder from the feed system, directing hot humidified air through the batt as it passes over the upper portion of the cylinder, and forming a localized low pressure zone within the plenum. Debris removed from the batt is entrained in the air flow. The method may further include directing air with entrained debris from the plenum to a battery condensing unit. The step of forming a localized low pressure zone comprises drawing air from the plenum with a fan.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 5:
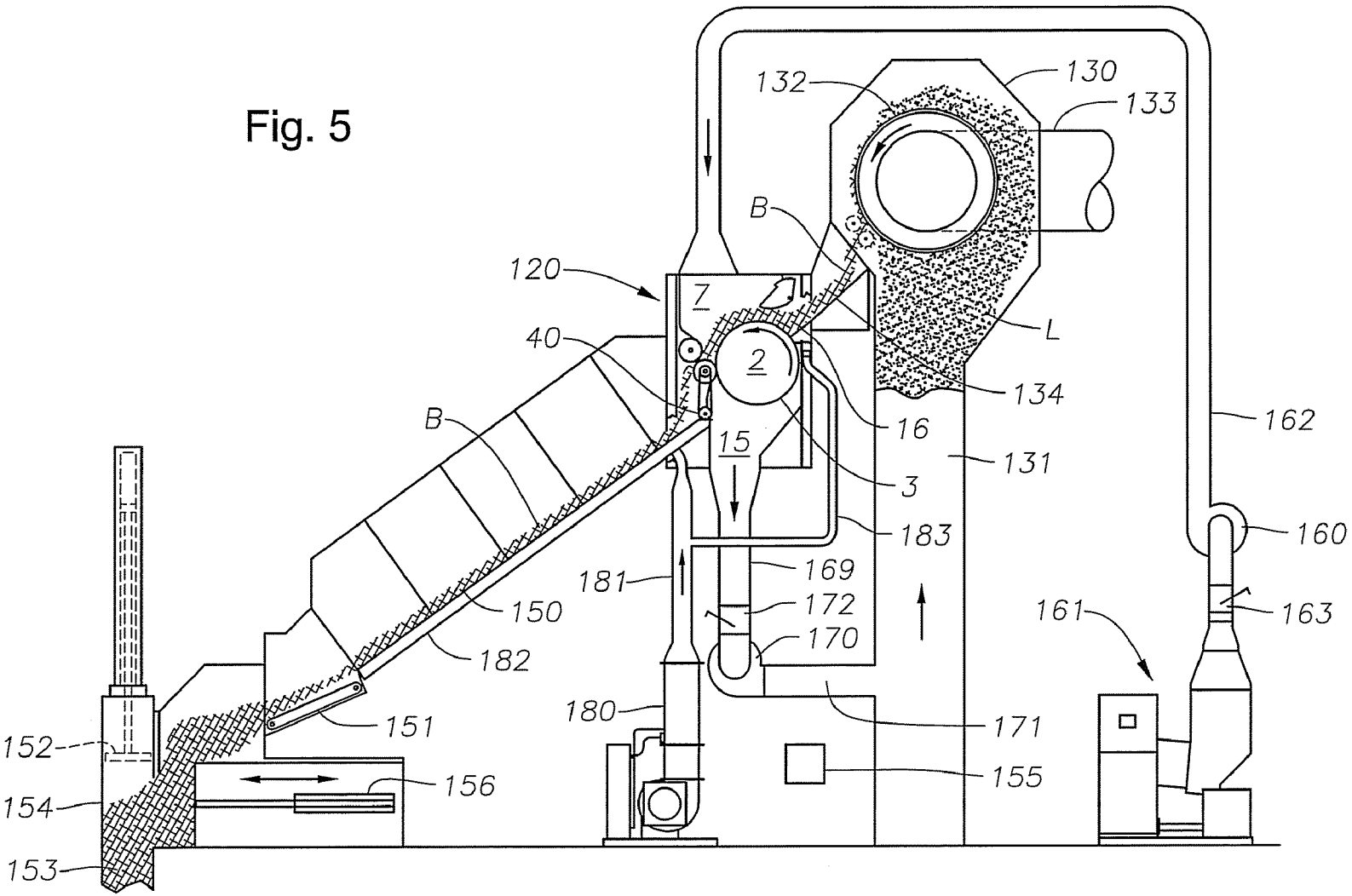
FIG. 5 is a schematic side view of the apparatus of FIG. 1 installed in a conventional cotton ginnery with associated equipment.

Referring now to FIG. 5, lint cotton L coming from lint cleaning machines (not shown) is directed to battery condenser 130 in an air stream flowing through a lint flue riser 131. Battery condenser screen 132 separates lint L out of the air stream and creates cotton batt B. The air stream continues out of the condenser 130 in a pipe 133 to a fan (not shown). Batt B is a blanket of cotton that flows out of battery condenser 130 and slides down an inclined surface (usually 35 to 40 degrees) called a feed ramp 134. The feed ramp 134 directs batt B into the lint conditioner apparatus 120. The cotton batt B moves through the lint conditioning apparatus 120 before being deposited on lint slide 150.

Figure 1:
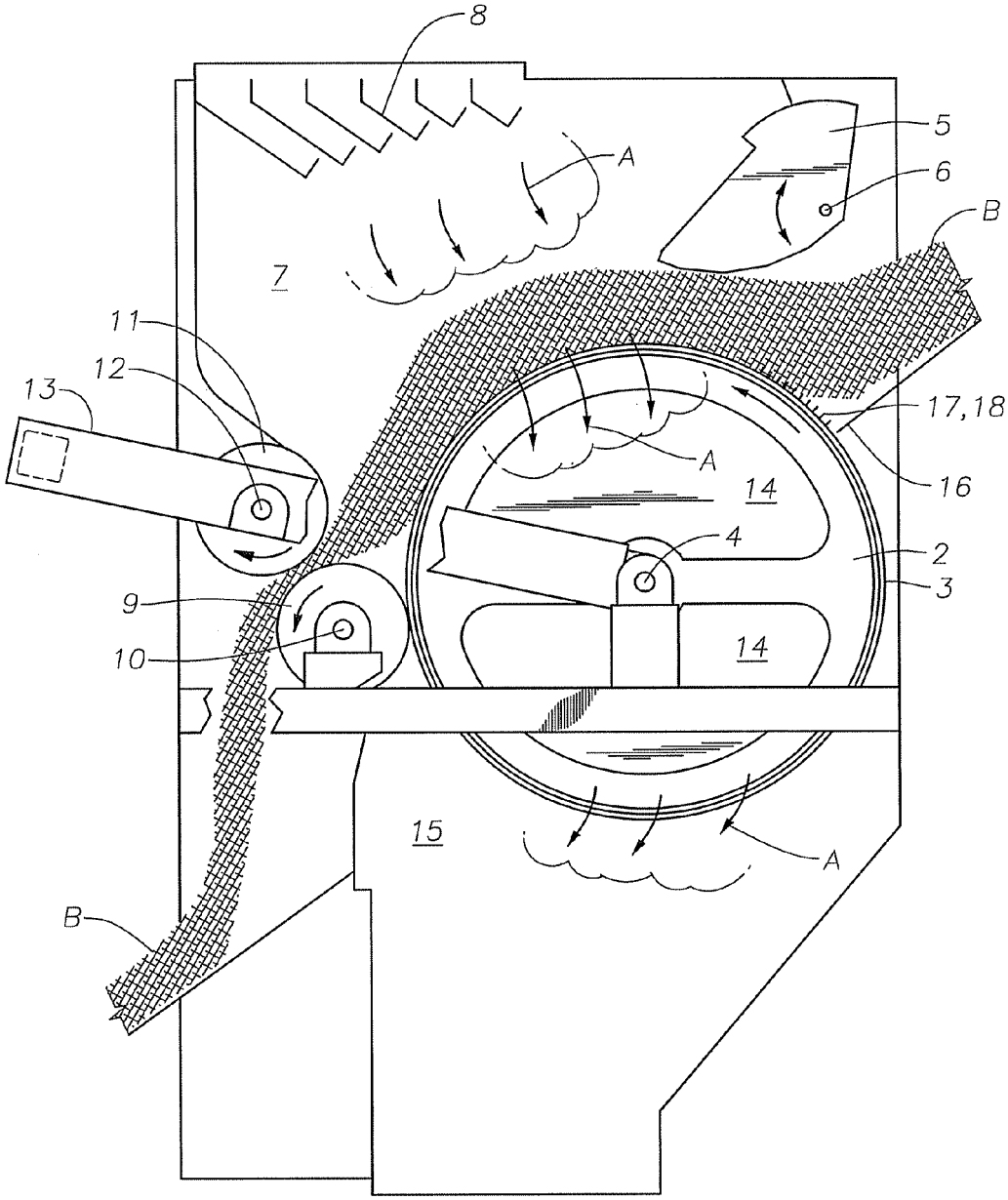
FIG. 1 is a side view of an embodiment of a moisture conditioning apparatus built in accordance with the invention, having a rotatable hollow cylinder, an air plenum, a pivoting air seal door, a doffer roller, a compression roller and link arm.

Referring to FIG. 1 an embodiment of the lint moisture conditioning apparatus 120 is shown in a side view. The conditioning apparatus 120 illustrated includes a hollow cylinder 2 with a perforated sheet metal surface 3 rotatable about an axle 4. The perforations 17 on the surface 3 form annular protrusions 18 thereon formed for gripping the batt and advancing it with rotation of the cylinder 2. In the embodiment shown, cylinder 2 has a 43-inch diameter (1.09 meter). In one embodiment, the surface of cylinder 2 and screen 3 are both formed from 16-gauge stainless steel punched with 9/32 inch (7.14 mm) holes staggered on 3/8 inch (9.53 mm) centers resulting in 51% open area through which air may pass. The hole pattern is chosen to maximize air flow therethrough.

A continuous batt of cotton B is pulled into the apparatus on feed apron 16 directing the batt B to top of cylinder 2 by the gripping action of the perforated surface 3. The feed apron 16 is between the feed ramp 134 and the cylinder 2. The feed apron 16 and the feed ramp 134 comprise a feed system for directing the batt B to the lint conditioner apparatus 120. A horizontally pivoted door 5 pivotally mounted on axle 6 pivots open as the fiber batt B is drawn into the inlet air plenum 7. The batt B is in sealing contact with the bottom portion of the door 5 thus disallowing humid air to escape from inlet air plenum 7 into the atmosphere. The door 5 also prevents humid air flow towards the battery condenser (not shown) from which fiber batt B is flowing and keeps excessive ambient air from entering the apparatus with batt B.

Humid air entering into air plenum 7 is distributed evenly throughout the plenum area where the batt B is flowing on the surface 3 by a set of air louvers 8 positioned in the air inlet of the air plenum 7. The air louvers 8 are comprised of several blades which direct the humid air flow toward the batt B. One example of suitable air flow is air from about 120 deg F. to about 160 deg F. (49 deg C. to 71 deg C.) and from about 70% to about 100% relative humidity.

A doffer roller 9 is rotatably mounted on an axle 10 and situated downstream of cylinder 2. The outer surfaces of cylinder 2 and roller 9 are separated by a very small gap configured to doff the batt B from the surface 3. During operation the roller 9 rotates in the same direction as cylinder 2. A second roller 11, constructed in same manner as roller 9, rotates in an opposite direction to that of roller 9. The fiber batt B is compressed between the doffer roller 9 and the second roller 11 after being doffed from the cylinder 2. The second roller 11 also provides a positive feed out conveying action for the fiber batt B as roller 11 rotates in opposite direction to that of doffer roller 9. Roller 11 is mounted on axle 12, where both the roller 11 and axle 12 are held at a constant distance from cylinder 2 and doffer roller 9 by a pair of link arms 13. Link arms 13 pivot about axle 4.

In the embodiment shown, four solid removable end panels 14 cover two openings in each end face of cylinder 2. End panels 14 allow access to the interior of cylinder 2 for cleaning and inspection when they are removed. End panels 14 also seal the ends of cylinder 2 so a proper amount of air flows through the perforated surface 3. A proper amount of air is needed to introduce moisture to the batt as well as having the batt flow through the apparatus. As discussed in more detail below, a pressure gradient is formed across the cylinder 2 sufficient to force air perpendicularly through the batt B, cylinder 2 upper surface, and cylinder 2 lower surface. For the purposes of discussion herein, the upper surface of the cylinder 2 refers to that portion of the cylinder 2 residing proximate to the inlet air plenum 7; similarly the lower surface of the cylinder 2 refers to the portion of the cylinder 2 proximate to the exhaust air plenum 15. The pressure gradient across the cylinder 2 is formed by the combination of the forced air flow exiting the air louvers 8 and a fan 170 in communication with the exhaust air plenum 15. The fan 170 is configured to draw a vacuum in the exhaust air plenum 15. Arrows A represent the air flow passing from the louvers 8 to the exhaust air plenum 15.

Figure 2:
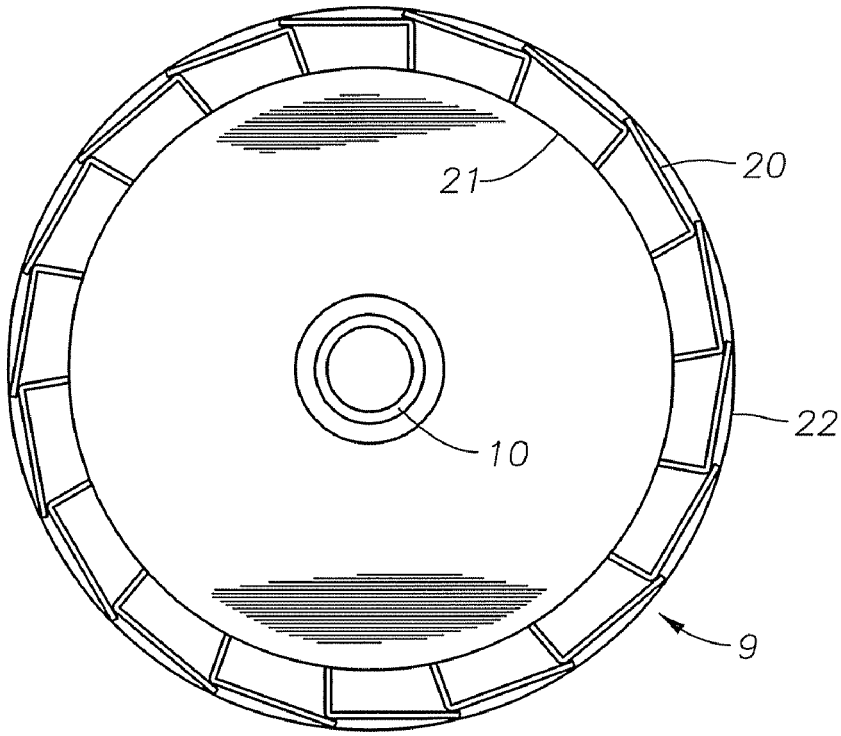
FIG. 2 is a sectional side view of the doffer roller of FIG. 1.

Referring now to FIG. 2, the outer surface of doffer roller 9 is formed by a plurality of irregularities. In the embodiment shown, the irregularities comprise a series of 12 gauge longitudinal stainless steel, 90-degree members of angle pieces 20. Angles 20 are welded together around a cylindrical hub 21 on one end and roller end plate 22 the other end. In one example, the roller end plate 22 has a 12 inch diameter (305 mm). Angles 20 form a generally cylindrical exterior with one leg of each angle 20 protruding almost tangentially from the surface of roller end plate 22. Angles 20 are disposed about and parallel to an axis of rotation hub 21. Each angle has a leading edge and a trailing edge. The leading edge of each angle 20 overlies and contacts the trailing edge of an adjacent angle 20. Angles 20 give roller 9 a strong and aggressive surface to doff cotton batt B from cylinder 2 and press it against compression roller 11. The orientation of the angles 20 shown in FIG. 2 represents their installation in the apparatus relative to view of cylinder 2 shown in FIG. 1.

Figure 3:
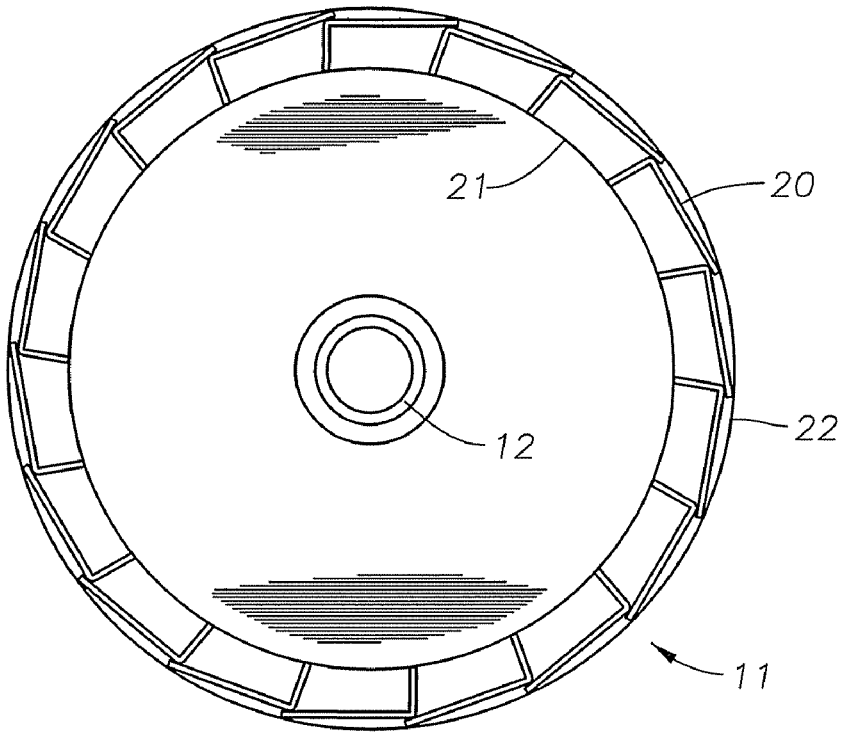
FIG. 3 is a sectional side view of the compression roller of FIG. 1.

Referring now to FIG. 3, the construction of compression roller 11 is constructed in the same manner as doffer roller 9. The compression roller 11 is similar to the doffer roller 9. the compression roller 11 is rotatably disposed on a hub axle 12 and comprises angles 20 welded between a hub 21 on one end and a roller end plate 22 on the other. The angles 20 as shown represent their installation in the apparatus relative to the cylinder 2 view shown in FIG. 1. Angles 20 give a strong and aggressive surface to feed the cotton batt B out of the apparatus while compressing the batt B against doffer roller 9.

Figure 4:
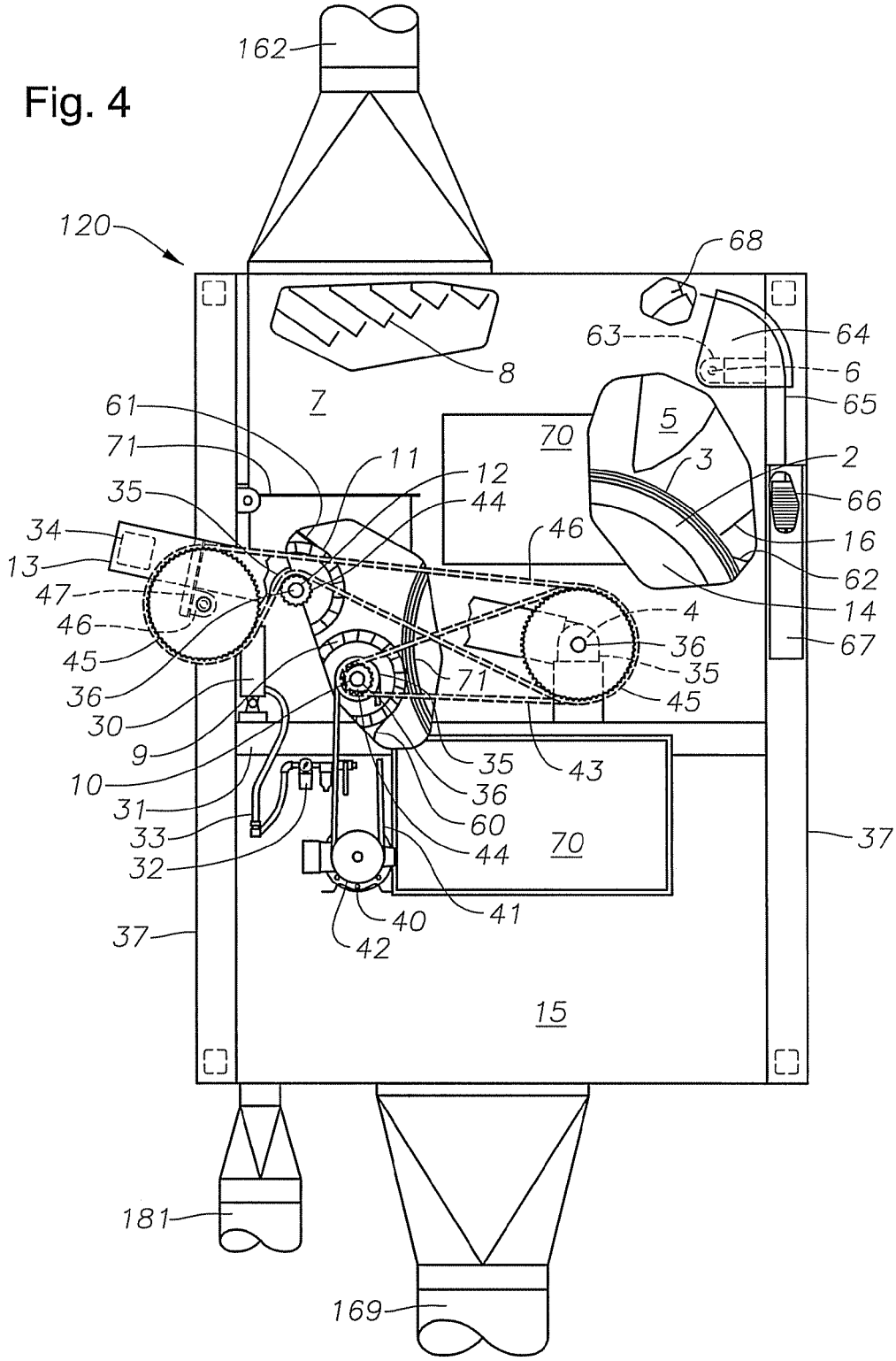
FIG. 4 is a partial sectional side view of the apparatus of FIG. 1 showing additional elements of the invention.

Referring now to FIG. 4, a pair of pneumatic linear actuators 30 mounted on frame 31 movably support the pair of link arms 13. Actuators 30 are positioned to act as a mechanical stop to maintain a minimum clearance of between doffer roller 9 and compression roller 11. In one example of use the minimum clearance is about one inch (25.4 mm). Actuators 30 also limit the amount of force compression roller 11 exerts on batt B when pressing against doffer roller 9. An air pressure regulator 32 supplies pressurized air to actuators 30 through hoses 33. In the preferred embodiment, actuators 30 have 2.5 inch diameter (63.5 mm) bores which operate at approximately 30 psi (206.8 kPa). A cross brace 34 rigidly connects link arms 13 together to maintain them in the same rotational plane to keep the outer surfaces of doffer roller 9 substantially parallel to compression roller 11 across its entire width.

Cylinder 2, doffer roller 9 and compression roller 11 rotate on axles 4, 10 and 12 respectively, in bearings 35 mounted on the link arms 13 and the frame 31. Axles 4, 10 and 12 are clamped to cylinder 2, roller 9 and roller 11 with keyless bushings 36. Support structure 37 provides framework for the assembly and a structure to facilitate installing the apparatus in a gin.

Regarding one example of a drive train for use with the apparatus described herein, the output shaft of a 5 horsepower (3.73 kW) motor gear reducer assembly 40 is connected to axle 10 with belt 41 on sheaves 42. As shown in the embodiment of FIG. 4, the axle 10 of doffer roller 9 is connected to axle 4 of cylinder 2 with a No. 60 size roller chain 43 passing around a 16-tooth sprocket 44 and a 60-tooth sprocket 45. This selection for sprockets results in a five percent increase in the surface speed of doffer roller 9 relative to cylinder 2. This surface speed increase provides a drafting action of batt B off of cylinder 2 by doffer roller 9. A drafting action prevents the fiber batt from compressing when passing between adjacent rollers. The fiber batt slightly stretches due to the increased surface speed of the receiving roller over that of the preceding roller.

Also as shown in the embodiment of FIG. 4, the axle 12 of compression roller 11 is connected to axle 4 of cylinder 2 with a No. 60 size roller chain 46 passing around a 16-tooth sprocket 44 mounted on axle 12 and a 60-tooth sprocket 45 mounted on axle 4. In connecting axle 12 to axle 4, roller chain 46 passes around a second 60-tooth sprocket 45 mounted on axle 46 on link arm 13. Axle 46 rotates on bearings and idler take up frame 47. Roller chain 46 creates a serpentine path to reverse direction of compression roller 12 relative to doffer roller 9. Compression roller 11 rotates in an opposite direction from doffer roller 9 and cylinder 2 so that cotton batt B feeds out of apparatus 120. Bearings and idler take up frame 47 allows a method to tension roller chain 46.

Referring to FIGS. 1 and 4, warm humid air enters the inlet air plenum 7. The air louvers 8 distribute the air evenly across the width of the air plenum 7 and direct the air toward batt B. After the air passes through the batt B and cylinder 2, it is drawn into the exhaust air plenum 15 by virtue of the above discussed pressure differential. To ensure constant air flow through the cylinder 2, the volumetric flow rate of air evacuated from exhaust air plenum 15 exceeds the volumetric rate of air supplied to inlet air plenum 7 thereby maintaining a steady state mass flow rate of air. As a result, none of the warm humid air escapes to condense moisture on feed inlet ramp 16. Air seals 60, 61 and 62 rub against doffer roller 9, compression roller 11 and cylinder 2, respectively, to minimize infiltration of ambient air into the apparatus 120.

Access panels 70 located on each transverse side of inlet air plenum 7 and exhaust air plenum 15 are removable, allowing access to plenums (7, 15) for cleaning and inspection. Access panels 70 also allow access to removable end panels 14 on each end face of cylinder 2. Access panels 70 allow access to ends of doffer roller 9 and compression roller 11 for maintenance.

Brush seals 71 mounted on the end faces of cylinder 2 provide a rotating air seal between the end faces of cylinder 2 and the sides of inlet air plenum 7 and exhaust air plenum 15. Brush seals 71 also keep lint from batt B from migrating into the void area between the end faces of cylinder 2 and inlet air plenum 7 and exhaust air plenum 15.

Horizontally pivoting door 5 mounted on axle 6 in bearings 63 also limits the ingress of ambient air into the inlet air plenum 7 and the egress of warm humid air out of inlet air plenum 7 while allowing batt B to enter the apparatus 120. Also attached to axle 6 is a pulley arc 64 for cable 65 to pass around. One end of cable 65 is anchored to the top side of pulley arc 64. Counterweights 66 are attached to the other end of cable 65. The counterweights 66 protrude through a tube 67 providing a vertical path for the weights to travel up and down in. The radius of the arc travel of pulley arc 64 about axle 6 is fixed so the downward pull of cable 65 about pulley arc 64 provides a constant torque on axle 6 to oppose the weight urging pivoting door 5 onto batt B. As batt B enters the apparatus, door 5 is gently nudged upward by both the batt B and the counterweight effect on door 5. Air seal 68 is positioned to provide a small gap between air seal 68 and the arc of the upper body of door 5 as the door 5 pivots on axle 6. In the illustrated embodiment, the air seal 68 is a stationary strip of rubber sandwiched between metal holders having a width substantially the same as the upper body of door 5. The air seal 68 is adjusted towards the door's upper body without touching the door.

An adjustable frequency drive package 155 controls the surface speed of cylinder 2 in relation to the surface speed of battery condenser screen 132. It is desirable for the surface speed of cylinder 2 to rotate 5 to 10 percent faster than the battery condenser screen 132 to draft batt B into the lint conditioning apparatus 120. If cylinder 2 rotates at an equal or lesser surface speed than screen 132, batt B will bunch up before reaching cylinder 2, thereby creating the possibility of a chokage. If cylinder 2 rotates in excess of 10 percent faster than screen 132, batt B will be pulled apart inside lint conditioning apparatus 120. Pulling batt B apart diminishes the humidification performance of the apparatus as humid air escapes through the breaks in batt B flowing through the apparatus. The adjustable frequency drive package 155 adjusts the frequency of the three-phase alternating current electrical power supplied to the motor gear reducer assembly 40 to obtain the desired surface speed.

The air handling systems are also shown in FIG. 5. A fan 160 pulls air through the humidifying unit 161. The air humidifying unit 161 heats the stream of air to a sufficient temperature to evaporate water into the air stream, thus raising the humidity level of the air. The warm humid air is directed to the fan 160 and to the inlet air plenum 7 of lint conditioner apparatus 120 through pipe 162. An adjustable metering valve 163 regulates the volume of air to about 2,200 cubic feet (62.3 cubic meters) per minute of standard air.

Another fan 170 evacuates the used humid air out of the exhaust air plenum 15. Pipe 169 directs the air from exhaust air plenum 15 to fan 170. Optionally, pipe 171 is used to direct flow from the discharge of the fan 170 to the lint flue riser 131. A small amount of lint L and foreign matter like leaf trash are extracted from the batt B during processing in the apparatus 120. Since recirculating the used humid air to lint flue riser 131 does not discharge to ambient air, the capital and operating expense of installing and operating lint removal devices is eliminated. An adjustable metering valve 172 regulates the volume of exhaust air to about 4,000 cubic feet (113.3 cubic meters) per minute of standard air.

A small fan and air heater combination 180 provides about 1000 cubic feet (28.3 cubic meters) per minute of standard air to pipe 181. The air is heated to about 180 degrees Fahrenheit (82.2 degrees Celsius). The heated air travels in pipe 181 to a dry hot air plenum 182 which is disposed under lint slide 150 which warms the surfaces of lint slide 150. Warming the surfaces contacted by batt B eliminates moisture condensation thus preventing sticking of batt B to cold surfaces. A pipe 183 branches off from hot air pipe 181 to carry dry hot air to a point under feed inlet apron 16. The pipe 183 discharges into the inner area of cylinder 2 which directs dry hot air through the perforated surface 3. The hot air warms the perforated surface 3 and prevents condensation thereon. Condensate deposits can attract lint and cause the perforated surface 3 to "hair over".

After being discharged from the lint conditioning apparatus 120, lint slide 150 directs the cotton batt B to the cotton charger 151. The cotton charger 151 and the press box pusher 156 fill the cotton into the press box 153. A tramper 152 compacts the cotton down in press box 153. The cotton is pressed into dense bales for transportation and storage with the bale press 154.

The invention has several advantages over prior art designs. Passing the batt B on the upper surface of the rotating cylinder 2 and forcing warm humid air through the batt B through the cylinder 2, areas for foreign material accumulation have been reduced. Eliminating areas for foreign material accumulation reduces operating downtime required for cleanup. Another advantage over prior art designs is the batt B is positively drafted into and out of the device by a large rotating cylinder with an aggressive screen and two aggressive rollers working in tandem to doff the batt off the rotating screen. The batt is compressed while it is fed out of the lint conditioner apparatus.

It is helpful to define terminology used in regards to a lint condenser, a battery condenser and a lint separator. A lint condenser is a device that separates airborne fiber from an air stream and condenses the fiber into a batt upon exiting the device. A battery condenser is the same as a lint condenser but is used in a cotton ginnery for receiving airborne lint cotton from a battery of cotton gin stands or lint cleaners. A lint separator is the same as a lint condenser except the term lint separator is used in a certain segment of the fibrous material processing industry.

It is to be understood that the invention is not limited to the exact details of construction, operation, exact materials, or embodiments shown and described, as modifications and equivalents will be apparent to one skilled in the art. For example, the device described herein is applicable for use to humidify wool, mohair and man-made fibers. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

The invention claimed is:

1. An apparatus for processing fibrous material, wherein the fibrous material comprises debris, the apparatus comprising:

a rotatable first cylinder having a cylindrical surface defining a hollow space therein, the cylinder having an upper portion and a lower portion;

perforations extending through the surface forming annular protrusions on the outer periphery of the perforations, wherein the protrusions define a rough side; wherein the rough side of the surface of the first cylinder is located on the exterior of the first cylinder to enhance gripping fibrous material being processed;

a feed system formed to deliver incoming fibrous material to the upper portion of the first cylinder;

a fan configured to direct air flow to the upper portion of the first cylinder, wherein the air flow passes through the fibrous material; and a plenum in communication with the lower portion of the first cylinder configured to receive debris removed from the fibrous material.

2. The apparatus of claim 1, further comprising a rotatable second cylinder having a generally cylindrical surface which has an exterior side which has a plurality of irregularities, the second cylinder being located downstream of and spaced apart from the first cylinder by a minimal distance such that the second cylinder doffs said first cylinder.

3. The apparatus of claim 1, wherein the air flow to the upper portion of the first cylinder flows into the hollow space within the cylinder through the material and perforations and exits the first cylinder into the plenum, and wherein debris from the fibrous material is carried to the plenum by the air flow.

4. The apparatus of claim 1, wherein the plenum is in communication with a fan suction line.

5. The apparatus of claim 1, wherein the air flow through the first cylinder creates a pressure differential between the upper and lower portion of the first cylinder.

6. The apparatus of claim 5, wherein the pressure differential forces fibrous material against the upper portion of the first cylinder.

7. The apparatus of claim 2 wherein the cylindrical surface of the second cylinder comprises a plurality of longitudinal members disposed about and parallel to an axis of rotation, each of the members having a leading edge and a trailing edge, the leading edge of each member overlying and contacting the trailing edge of an adjacent one of the members.

8. The apparatus of claim 1, wherein the air flow comprises hot humid air.

9. A cotton gin comprising:

a battery condenser;

a batt conditioning apparatus formed to receive a stream of fibrous material batt from the battery condenser, wherein the batt conditioning apparatus comprises a rotatable first cylinder having a cylindrical surface defining a hollow space therein, the cylinder having an upper portion and a lower portion, perforations extending through the surface forming annular protrusions on the outer periphery of the perforations, wherein the protrusions define a rough side and wherein the rough side of the surface of the first cylinder is located on the exterior of the first cylinder to enhance gripping fibrous material being processed;

a feed system formed to deliver the batt fibrous material to the upper portion of the first cylinder;

a humidifying unit configured to direct hot humid air flow to the upper portion of the first cylinder; and a plenum in communication with the lower portion of the first cylinder configured to receive debris removed from the fibrous material.

10. The cotton gin of claim 9, further comprising a fan formed to draw air from the plenum.

11. The cotton gin of claim 10, wherein the fan discharges into the batt condenser.

12. The cotton gin of claim 9, wherein the combination of the air from the humidifying unit blowing on the cylinder and the fan drawing air from the plenum creates a pressure differential on the first cylinder.

13. The cotton gin of claim 12, wherein the pressure differential forces the batt onto the cylinder and promotes air flow through the cylinder.

14. A method for processing a fibrous batt in a processor, wherein the processor comprises a rotatable hollow cylinder with perforations, a feed system, and a plenum, the method comprising:

(a) feeding the batt to the upper portion of the cylinder from the feed system;

(b) directing hot humidified air through the batt as it passes over the upper portion of the cylinder, wherein the air also passes through the cylinder and into the plenum, wherein the air flow removes debris from the batt; and (c) forming a localized low pressure zone within the plenum.

15. The method of claim 14, further comprising directing air with entrained debris from the plenum to a battery condensing unit.

16. The method of claim 14, further comprising doffing the batt from the cylinder with a roller.

17. The method of claim 14, wherein the step of forming a localized low pressure zone comprises drawing air from the plenum with a fan.

* * * * *